US008695897B2

(12) United States Patent
Engel

(10) Patent No.: US 8,695,897 B2
(45) Date of Patent: Apr. 15, 2014

(54) SHOWERHEAD WITH ROTATABLE OVAL SPRAY PATTERN AND HANDHELD SPRAY PATTERN CONTROLLER

(76) Inventor: Ray Engel, Modesto, CA (US)

( * ) Notice: Subject to any disclaimer, the term of this patent is extended or adjusted under 35 U.S.C. 154(b) by 0 days.

(21) Appl. No.: 13/385,660

(22) Filed: Feb. 29, 2012

(65) Prior Publication Data

US 2012/0175436 A1 Jul. 12, 2012

Related U.S. Application Data

(63) Continuation of application No. 12/386,273, filed on Apr. 15, 2009, now Pat. No. 8,177,147.

(51) Int. Cl.
*B05B 15/00* (2006.01)

(52) U.S. Cl.
USPC ..... 239/443; 239/393; 239/449; 239/556; 239/562; 239/599

(58) Field of Classification Search
CPC ..... B05B 1/048
USPC ..... 239/391–397, 437, 443–449, 548, 556, 239/561, 562, 567, 599, 587.1, 587.5
See application file for complete search history.

(56) References Cited

U.S. PATENT DOCUMENTS

| | | | | |
|---|---|---|---|---|
| 1,597,477 | A * | 8/1926 | Panhorst | 239/548 |
| 3,917,172 | A | 11/1975 | O'Hare | |
| 4,193,553 | A | 3/1980 | Kelly et al. | |
| 4,294,280 | A | 10/1981 | Tom | |
| 4,623,095 | A | 11/1986 | Pronk | |
| 4,941,616 | A | 7/1990 | Liebler | |
| 5,199,639 | A | 4/1993 | Kobayashi et al. | |
| 5,316,216 | A | 5/1994 | Cammack et al. | |
| 5,433,384 | A | 7/1995 | Chan et al. | |
| 5,476,225 | A | 12/1995 | Chan | |
| 5,915,622 | A | 6/1999 | Foote | |
| 5,961,049 | A | 10/1999 | Kaps | |
| 6,045,062 | A | 4/2000 | Bosio | |
| 6,145,757 | A | 11/2000 | Knapp | |
| 6,254,014 | B1 | 7/2001 | Clearman et al. | |
| 6,264,121 | B1 * | 7/2001 | McClary | 239/525 |
| 6,367,710 | B2 | 4/2002 | Fan | |
| 6,419,166 | B1 | 7/2002 | Brzezinski et al. | |
| 6,622,945 | B1 | 9/2003 | Wu et al. | |
| 6,647,566 | B1 | 11/2003 | Wang | |
| 6,817,550 | B2 | 11/2004 | Taylor et al. | |
| 7,093,775 | B1 | 8/2006 | Bingham | |
| D533,253 | S * | 12/2006 | Luettgen et al. | D23/229 |
| 7,147,172 | B2 | 12/2006 | Darling et al. | |
| 2008/0156902 | A1 | 7/2008 | Luettgen et al. | |
| 2008/0289097 | A1 * | 11/2008 | Jeong | 4/615 |

* cited by examiner

*Primary Examiner* — Jason Boeckmann
(74) *Attorney, Agent, or Firm* — Russo & Duckworth, LLP; David G. Duckworth

(57) ABSTRACT

A handheld showerhead assembly is provided which provides for a plurality of spray patterns. In a preferred embodiment, the showerhead assembly provides for four spray patterns including an oval shaped spray pattern. The showerhead is rotatably attached to the handle so that the showerhead can be rotated relative to the handle without altering spray patterns, other than their orientation. Furthermore, the handheld shower assembly includes a push button controller located within the handle.

6 Claims, 17 Drawing Sheets

SHOWERHEAD WITH ROTATABLE OVAL SPRAY PATTERN AND HANDHELD SPRAY PATTERN CONTROLLER

RELATED APPLICATION

The present application is a continuation application of U.S. patent application Ser. No. 12/386,273, filed Apr. 15, 2009 now U.S. Pat. No. 8,177,147.

BACKGROUND OF THE INVENTION

The present invention relates to showerheads. More particularly, the present invention relates to handheld showerheads producing a plurality of spray patterns and control mechanisms for the control of such spray patterns.

Spray heads are commercially available in numerous designs and configurations for use in showers, faucets, spas, sprinklers and other personal and industrial systems. The vast majority of spray heads may be categorized as being either stationary or oscillating and have either fixed or adjustable openings. Stationary spray heads with fixed jets are the simplest constructions consisting essentially of a central conduit connected to one or more spray jets directed to produce a constant pattern. The stationary spray showerheads cause water to flow through the construction to contact essentially the same points on a user's body in a repetitive fashion.

Multifunction showerheads are able to deliver water in any of many different spray patterns such as a fine spray, a coarse spray, a pulsating spray, or even a flood pattern providing high fluid flow but decreased velocity. Of course, many other spray patterns may also be provided.

A conventional multifunction showerhead generally requires the user to turn a selector ring or dial on the showerhead faceplate in order to select a desired function. Another approach is to provide a faceplate with several spray jets located in concentric circular patterns. An internal controller, such as controlled by buttons or the like, may be operated to direct the incoming water to any of the various patterns. Examples of such constructions are disclosed in U.S. Pat. Nos. 5,433,384 and 6,622,945.

Unfortunately, these conventional multifunction controllers suffer from various drawbacks. For example, turning a ring or pushing a button adjacent to the showerhead can be difficult to perform by persons having soapy hands. Furthermore, persons tend to look at the showerhead while turning a selector dial or when pushing a button which causes an undesirable spray into a person's face, particularly when a spray pattern changes from a narrow stream to a wide spray.

Handheld showerheads suffer from similar complications. A handheld showerhead typically includes a hollow handle connected to a water supply by a flexible rubber hose. In addition to having the above-described drawbacks of it being difficult to rotate a selector dial or push a button with soapy hands, a person holding the showerhead must utilize both hands, one for holding the handle and the other to control the selector dial or button to change spray patterns.

Thus, there is a significant need for an improved handheld showerhead that is more easily controlled by a user. However, even if improved controls were provided, previous showerheads suffer from still additional problems.

For example, the human body presents a vertically elongate structure, but a conventional showerhead typically produces a circular spray pattern. Thus, a person receiving water from a showerhead typically will have their face and upper torso sprayed or their lower torso and feet sprayed, but not both.

Attempts have been made to develop a showerhead producing an oval spray pattern. For example, U.S. Pat. No. 5,316,216 describes a showerhead having peripheral spray jets positioned in a circular pattern. However, the various jets are angled to produce an oval spray pattern. Similarly, U.S. Pat. No. 6,254,014 indicates that nozzles can be developed to produce an oval spray pattern. Unfortunately, neither of these prior art showerheads permit the rotation of the spray pattern which may be desirable, for example, when a person desires a horizontal spray pattern which may be needed if a person is in a more prone position or desires a more horizontally spread spray.

Thus, it would be desirable to provide a showerhead producing an oval spray pattern wherein the oval spray pattern could be rotated from horizontally aligned to vertically aligned.

It would further be advantageous to provide a handheld showerhead producing a variety of selectable spray patterns including at least one oval spray pattern which could be independently rotated.

SUMMARY OF THE INVENTION

Briefly, in accordance with the invention, an improved showerhead assembly is provided having two significant improvements. A first improvement provides for rotation of the showerhead spray pattern. Meanwhile, the second improvement provides for improved manual control for selecting various spray patterns.

Like typical handheld showerhead apparatus, the showerhead apparatus of the present invention includes an elongate hollow handle having a central conduit. The central conduit has an inlet which preferably is threaded for connecting to a traditional rubber hose which in turn is connectable to a water supply such as a pipe projecting from a shower wall. In addition, the central conduit possesses an outlet for expelling water to the showerhead. Like traditional handheld showerhead assembly, the elongate handle defines a longitudinal axis and the showerhead face and resulting spray is angled relative to the elongate handle's longitudinal axis to be more manageable within a shower. Preferably, the showerhead is angled relative to the handle's central axis by greater than 45° and less than 135°. More preferably, the showerhead face expels water at an angle greater than 90° and less than 120° relative to the handle's central axis.

Unlike traditional showerhead assemblies, a preferred handheld showerhead of the present invention possesses a central conduit including both a fixed pipe as well as a rotatable pipe. The fixed pipe is positioned within the proximal extremity to the handle's housing. The fixed pipe includes a threaded inlet coupling connectable to a rubber hose or the like. Furthermore, the fixed pipe includes an outlet for coupling to the rotatable pipe's inlet. The fixed pipe and rotatable pipe are connected end-to-end in an axial arrangement to form a single central conduit wherein the rotatable pipe extends from the fixed pipe.

Affixed to the end of the rotatable pipe, the showerhead apparatus includes a coupling, preferably in the form of a "Y" connector. More specifically, the coupling has a single inlet port connected to the rotatable pipe's outlet for receiving water from the central conduit, but includes two outlet ports for expelling water. Rotation of the rotatable pipe causes the coupling to rotate about a central axis. The coupling's outlet ports are offset relative to the coupling's axis of rotation so that rotation of the coupling causes the outlet ports to rotate in a circular path.

The showerhead apparatus of the present invention further includes a diverter assembly which is positioned within the distal extremity of the handle's housing. The diverter assembly includes a receptacle portion for engaging and preferably encapsulating the "Y". In addition, the diverter assembly includes a plurality of diverter inlet ports which are concentrically aligned around the coupling's axis of rotation so as to selectively engage and disengage from the coupling's outlet ports as the coupling's outlet ports rotate about their circular path. The diverter assembly further includes a discharge portion which includes a plurality of discharge ports. The diverter assembly's inlet ports are connected to the diverter outlet ports by a plurality of discrete flow pathways so that water from the showerhead's central conduit is routed by the coupling into selected diverter inlet ports for direction through the diverter assembly's flow pathways to selected diverter outlet ports. As explained in greater detail below, the water expelled from each diverter outlet port provides a different shower spray pattern.

Moreover, the showerhead assembly of the present invention further includes a showerhead connected to the diverter assembly. The showerhead includes a plurality of showerhead inlet openings coupled to the diverter assembly's corresponding plurality of outlet ports. The showerhead further includes a plurality of sets of spray holes with each set of spray holes connected to a showerhead inlet opening by a discrete flow passageway. In a preferred embodiment, the showerhead includes four sets of spray holes providing four different showerhead spray patterns such as a narrow pulsating spray, a flood spray, a twin nozzle spray, and a peripheral spray pattern. Water provided by the diverter assembly is diverted into a showerhead inlet opening to be conveyed by a flow passageway to a set of spray holes to produce a selected shower spray pattern.

The showerhead assembly includes a controller for selecting the desired shower spray pattern. The controller is located in the handle's housing for selectively causing the rotation of the rotatable pipe. The controller can take various forms as can be selected by those skilled in the art such as a simple dial which extends through a hole formed in the handle's housing. However, the preferred controller includes a ratchet assembly wherein the rotatable pipe includes a plurality of teeth concentrically extending from the exterior of the rotatable pipe. A button projects through a hole formed in the showerhead's handle housing for selectively engaging and pushing the teeth so as to cause the rotatable pipe to rotate. This preferred ratchet assembly includes a biasing means such as a spring or clip for pushing the button away from the teeth.

In operation, the button is pressed so as to cause the teeth and corresponding rotatable pipe to rotate until the coupling is positioned so that the coupling's one or more outlet ports, preferably two ports, are aligned with selected diverter inlet ports so as to allow fluid flow through the central conduit (including fixed and rotatable pipes). Water is then capable of flowing through the coupling, through a first diverter flow pathway, and through a first showerhead passageway to a first set of spray holes to produce a first spray pattern. Depression of the ratchet assembly button will thereafter cause the rotation of the rotatable pipe and affixed coupling until the coupling's outlet ports are aligned with a second diverter inlet port. Once aligned, fluid is allowed to flow through the fixed pipe, rotatable pipe, coupling, and then through a second diverter flow pathway, and second showerhead passageway to a second set of spray holes to produce a second spray pattern. Preferably, the diverter assembly is constructed to include four inlet ports, and four outlet ports providing four discrete flow pathways, and the showerhead includes four corresponding inlet openings and four sets of spray holes connected by four discrete flow pathways to provide the four spray patterns described above. The showerhead passageways may incorporate venturi inlets to produce an air-water mixture which is expelled from the spray holes.

In a preferred embodiment, the showerhead apparatus is constructed so that the showerhead can rotate relative to the elongate handle without altering the spray pattern other than its orientation. Moreover, it is preferred that the showerhead provide an oval spray pattern. To this end, the showerhead spray holes are positioned or angled to create an oval spray pattern. The showerhead is connected to the handle by a coupling which allows the showerhead to rotate freely relative to the handle. The manual rotation of the showerhead allows the oval spray pattern to align vertically relative to the handle, or horizontally, or at any angle in between.

Therefore, it is an object of the present invention to provide a handheld showerhead having a plurality of selectable spray patterns wherein the controls for selecting the spray patterns are positioned within the handle.

It is an additional object of the invention to provide a handheld showerhead assembly producing an oval spray pattern which can be rotated from vertical to horizontal without changing the spray pattern other than its orientation.

These and other more specific advantages of the invention will be apparent to those skilled in the art from the following detailed description taken in conjunction with the drawings.

DETAILED DESCRIPTION OF THE INVENTION

Figure 1:
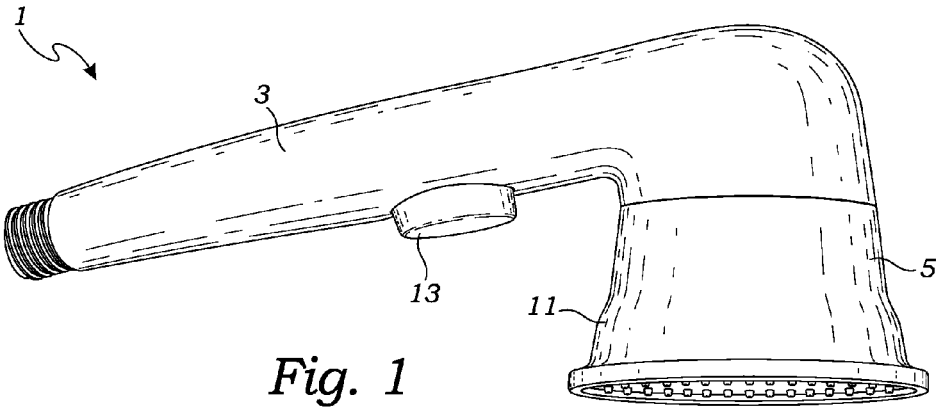
FIG. 1 is a perspective view of the showerhead assembly of the present invention.

While the present invention is susceptible of embodiment in various forms, as shown in the drawings, hereinafter will be described the presently preferred embodiments of the invention with the understanding that the present disclosure is to be considered as an exemplification of the invention, and the present disclosure is not intended to limit the invention to specific embodiments illustrated.

With reference to all FIGS. 1-30, the handheld showerhead assembly 1 of the present invention includes an elongate handle 3 including a hollow handle housing 9. The handle has a proximal end in the form of a threaded inlet 7 for connecting to a water source, such as a rubber hose 97 connected to household or commercial plumbing. At the handle's distal end, the showerhead assembly includes a showerhead 5 having a showerhead housing 11. Like traditional handheld showerhead assemblies, the showerhead 5 has a showerhead face 15 including numerous spray holes 17*a*-17*d* for expelling water in the form of various spray patterns. As illustrated in FIG. 1, preferably the handle assembly 3 includes a bend at its distal end for projecting the showerhead face 15 at an angle relative to the longitudinal axis of the handle 3. Preferably, the handle bend and showerhead face 15 are angled relative to the showerhead handle at greater than 45° and less than 135° relative to the handle's central longitudinal axis. As illustrated in the figures, a preferred handle bend projects the showerhead at an angle of approximately 105° relative to the handle's central axis.

Advantageously, the showerhead assembly 1 of the present invention includes two distinct advantages over previous showerhead assemblies. First, the showerhead assembly includes a controller within the handle for selecting various spray patterns produced by the showerhead. The controller may take various shapes. However, the controller is spaced away from the showerhead within the housing, such as 1-5 inches, sufficient to facilitate one-handed operation of the controller. A preferred controller includes a button which projects through a hole 10 (see FIG. 6) formed in the handle's housing 9. The button is covered by a button cover 13 which is depressed for selecting a desired spray pattern. An additional advantage of the showerhead assembly of the present invention is that it provides for production of an oval spray pattern which is rotatable. As illustrated in the figures, the showerhead 5 includes an oval face 15 having spray holes 17*d* positioned in an oval arrangement to produce an oval spray pattern. Advantageously, the entire showerhead portion 5 is rotatable relative to the handle 3 without changing the spray pattern other than its orientation from horizontal to vertical to any angle therebetween.

With reference particularly to FIGS. 5-8 and 25, the showerhead assembly 1 includes a central conduit 23 located within the handle's housing 9. Preferably, the central conduit is constructed of two pieces including a fixed pipe 29 and a rotatable pipe 39. The fixed pipe 29 includes the showerhead assembly's threaded inlet 7 at the fixed pipe's proximal extremity 25. Meanwhile, the rotatable pipe 39 connects axially to the fixed pipe's distal extremity 37. In turn, the rotatable pipe 39 connects to the fixed pipe 29 in an axially aligned fluid-tight arrangement which provides for rotation of the rotatable pipe 39 relative to the fixed pipe 29. As illustrated, the fixed pipe's outlet 35 projects into the rotatable pipe's inlet 41 located at the rotatable pipe's proximal end 43. O-rings 63 are provided to provide a fluid tight connection. The rotatable pipe 39 then extends distally within the showerhead assembly's handle 33 toward the showerhead 5.

Figure 6:
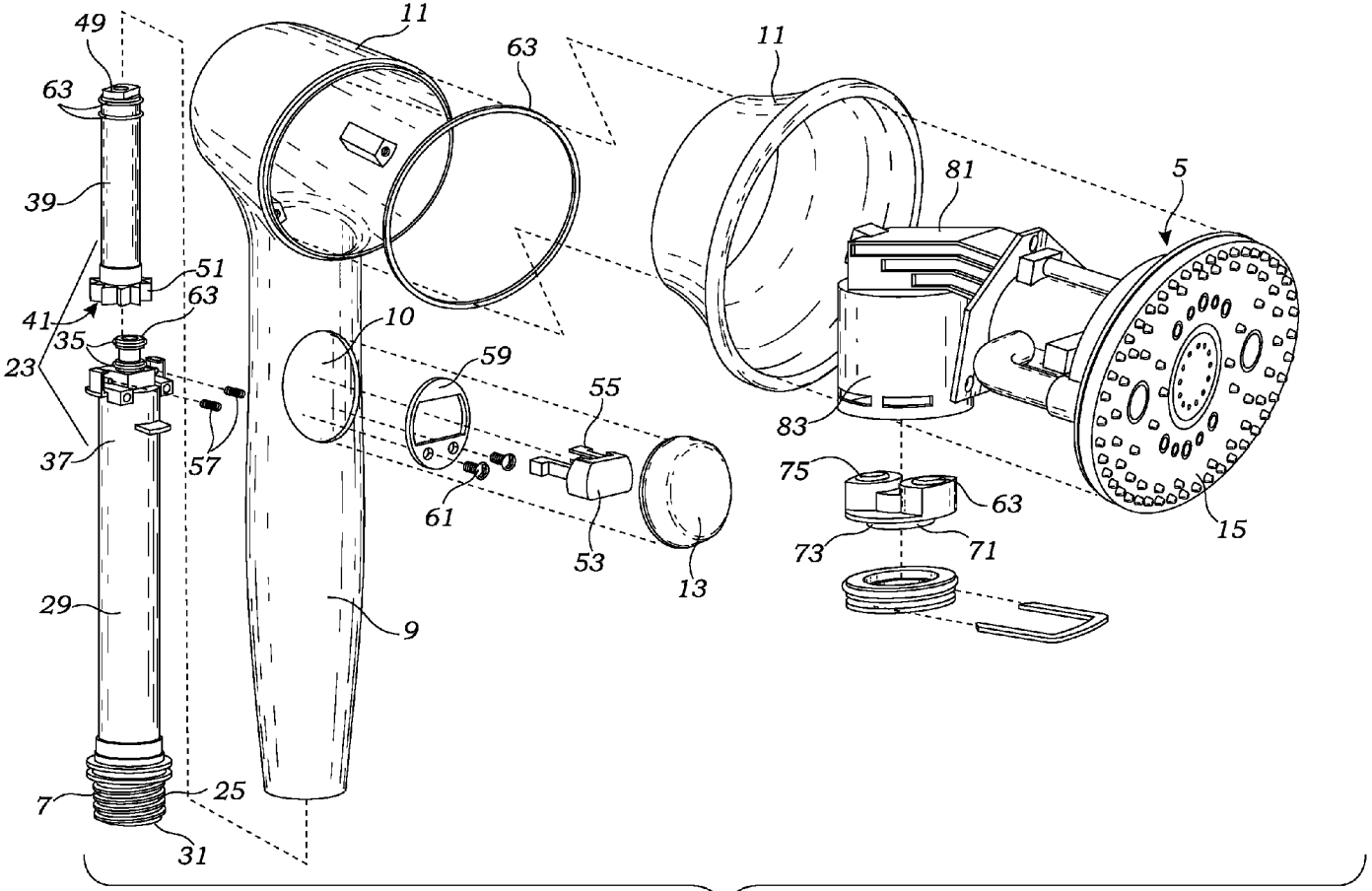
FIG. 6 is an exploded perspective view of the showerhead assembly of the present invention.
Figure 7:
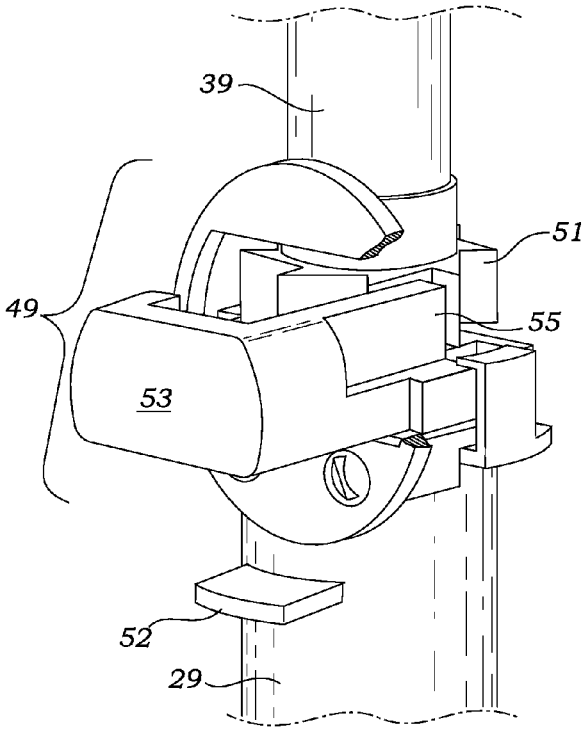
FIG. 7 is a perspective view of the ratchet assembly for use with the showerhead assembly of the present invention.
Figure 8:
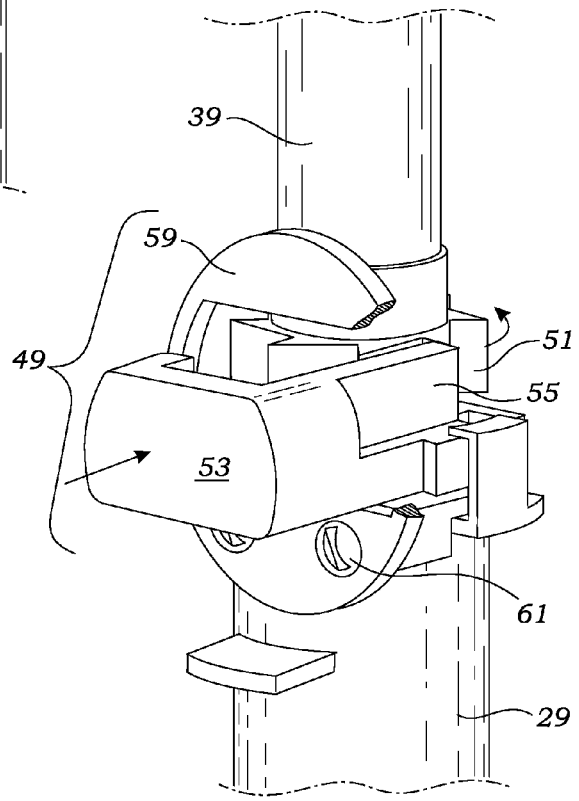
FIG. 8 is a perspective view of the ratchet assembly illustrating depression of the button which forms part of the showerhead assembly of the present invention.
Figure 9A:
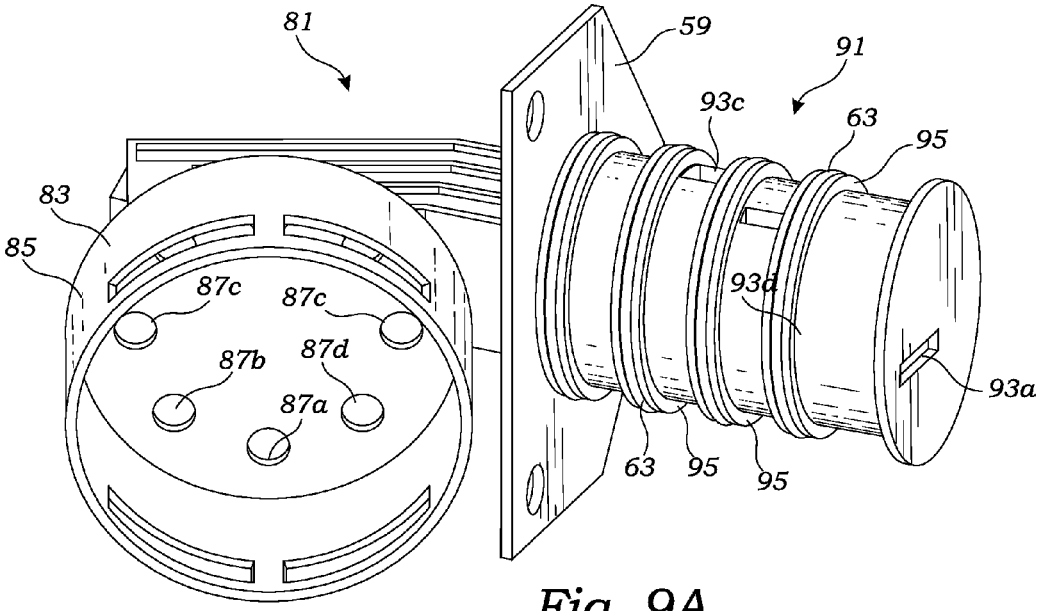
FIG. 9A is a top perspective view of the diverter assembly for use with the showerhead assembly of the present invention.
Figure 9B:
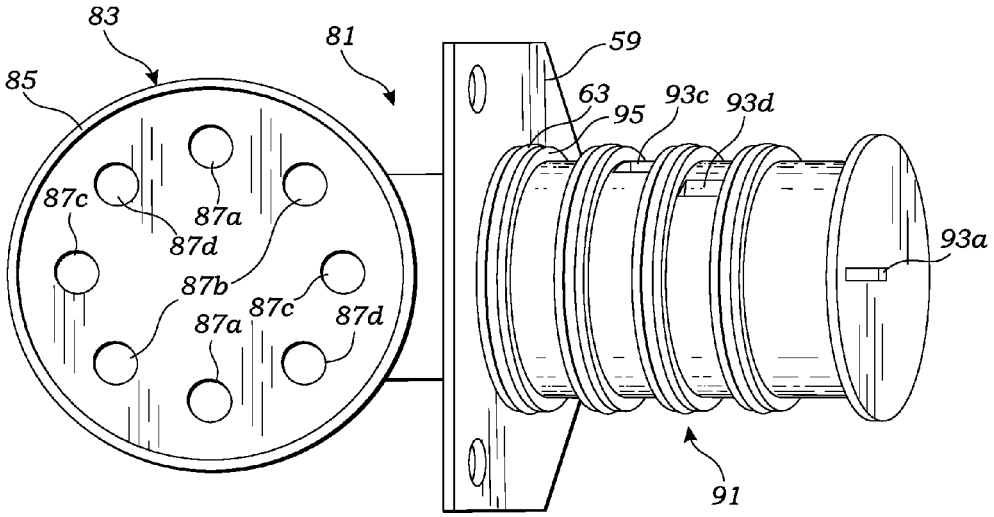
FIG. 9B is a front view of the diverter assembly for use with the showerhead assembly of the present invention.
Figure 10:
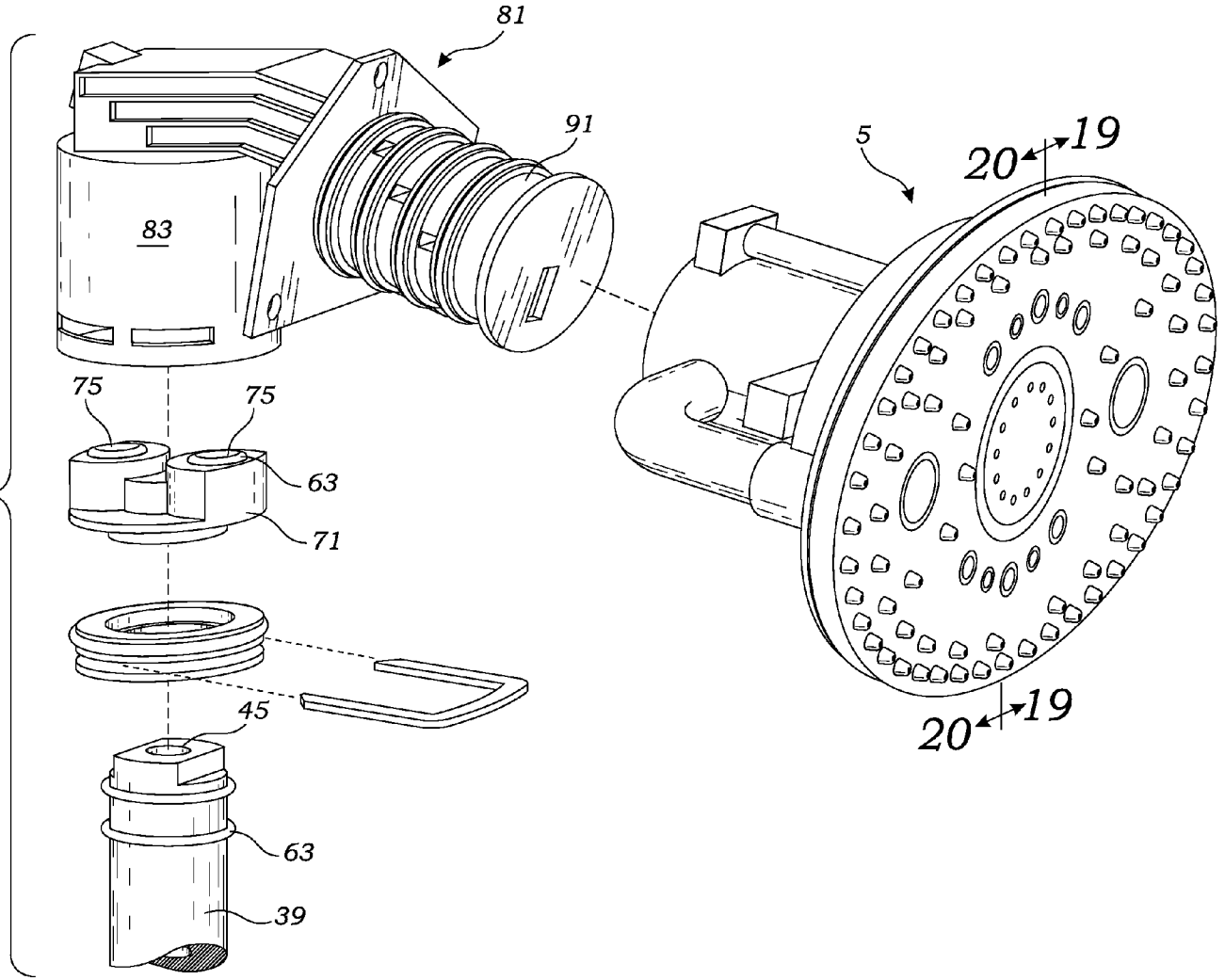
FIG. 10 is an exploded view illustrating the showerhead, diverter assembly, coupling and rotatable pipe for use with the showerhead assembly of the present invention.
Figure 12:
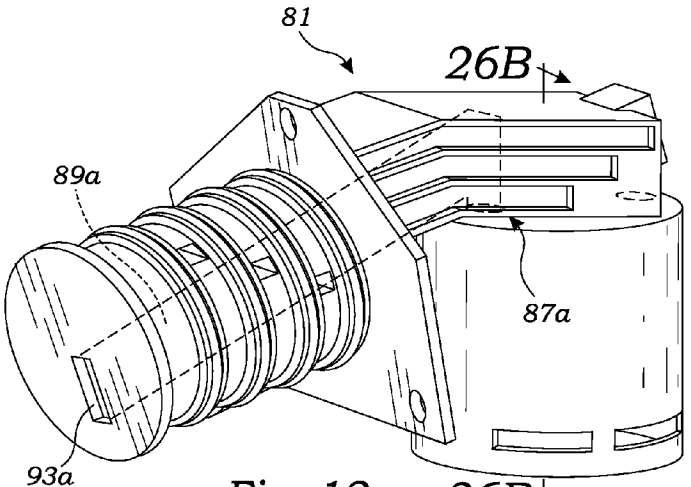
FIG. 12 is a right perspective view illustrating a first flow path within the diverter assembly.
Figure 11:
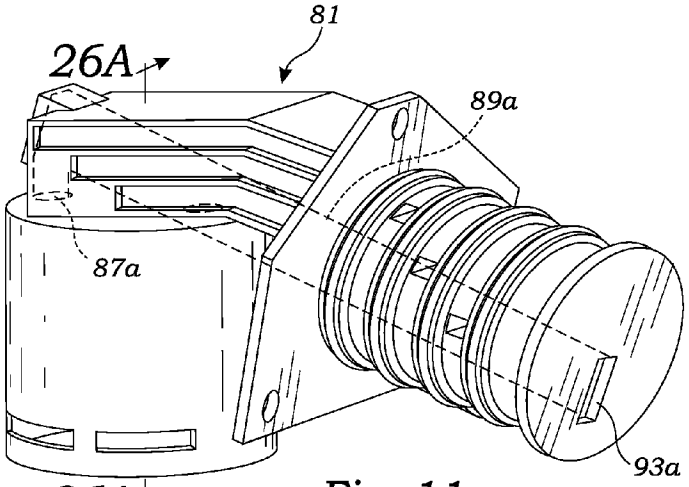
FIG. 11 is a left perspective view illustrating a first flow pathway through the diverter assembly.

Affixed to the rotatable pipe's distal end 47 is a coupling 71. The coupling 71 includes an inlet port 73 which connects and is affixed to the rotatable pipe's outlet 45, preferably utilizing a keyed press-fit construction 49. With reference to FIG. 6, the coupling includes at least one outlet port 75 offset relative to the coupling's central axis. In the preferred embodiment illustrated in the figures, the coupling 71 includes a pair of outlet ports 75 offset relative to the coupling's central axis.

With reference to FIGS. 6 and 9-18, the showerhead assembly 1 includes a diverter assembly 81. The diverter assembly includes a receptacle portion 83 and a discharge portion 91. The diverter assembly's receptacle portion 83 is constructed to mate and connect to the coupling 71 for receiving water supplied by the central conduit 23. To this end, the receptacle portion 83 includes a circular wall encapsulating the coupling 71. Furthermore, the receptacle portion includes a plurality of inlet ports 87*a*-87*d* for engagement to the coupling's outlet ports 75. The diverter assembly's receptacle portion 83 may include any number of inlet ports. However, as disclosed in the figures, a preferred embodiment of the showerhead assembly includes eight inlet ports including four pairs of inlet ports 87*a*, 87*b*, 87*c*, and 87*d*.

Figure 14:
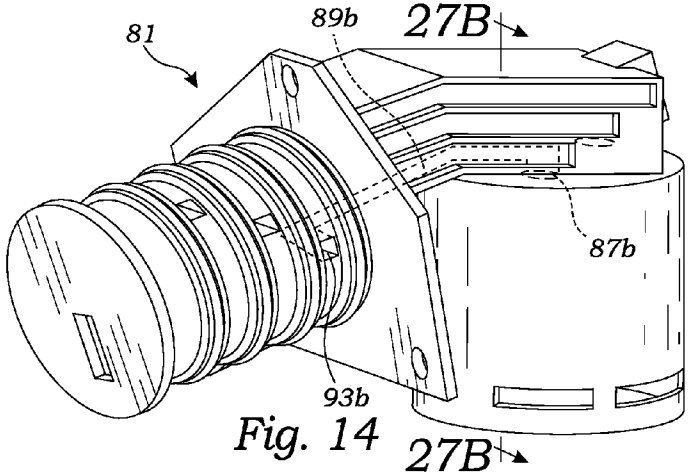
FIG. 14 is a right perspective view illustrating the second flow path through the diverter assembly.
Figure 13:
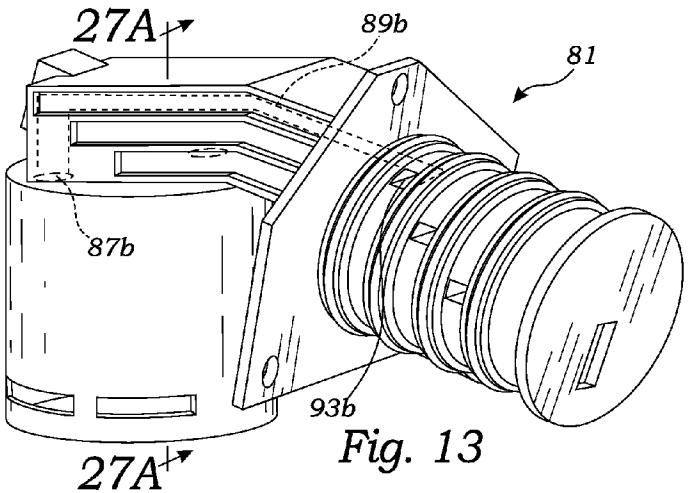
FIG. 13 is a left perspective view illustrating a second flow path within the diverter assembly.
Figure 16:
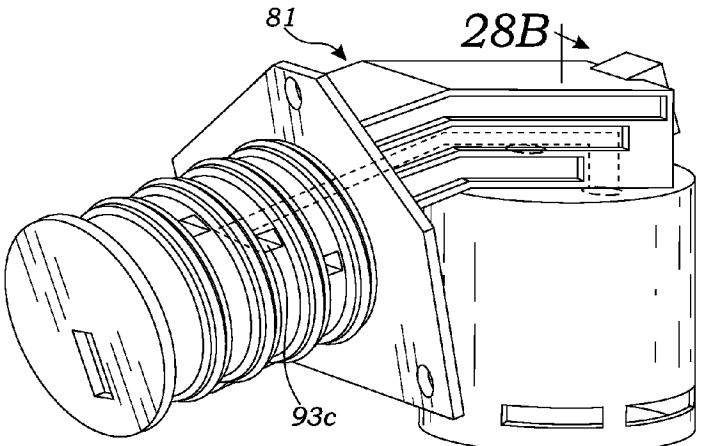
FIG. 16 is a right perspective view illustrating a third pathway through the diverter assembly.
Figure 15:
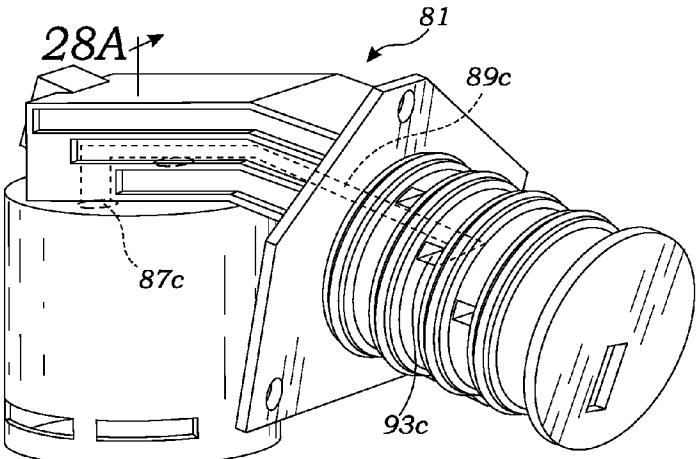
FIG. 15 is a left perspective view illustrating a third pathway through the diverter assembly.
Figure 18:
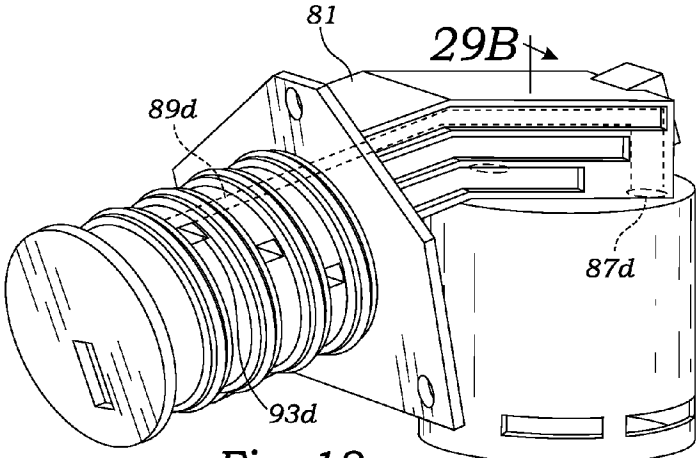
FIG. 18 is a right perspective view illustrating the fourth flow path through the diverter assembly.
Figure 17:
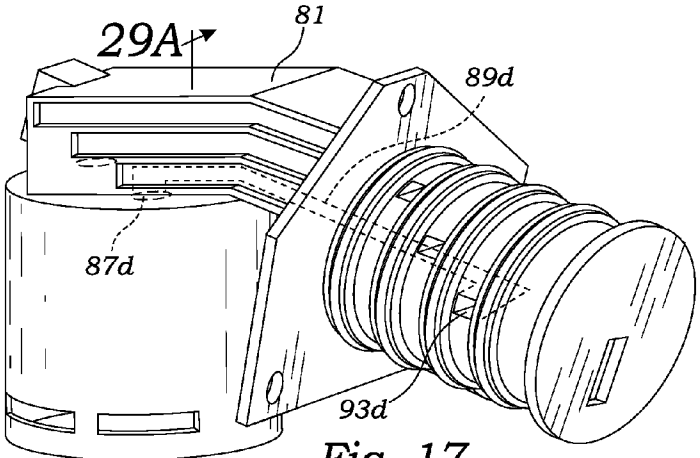
FIG. 17 is a left perspective view illustrating a fourth pathway through the diverter assembly.
Figure 19:
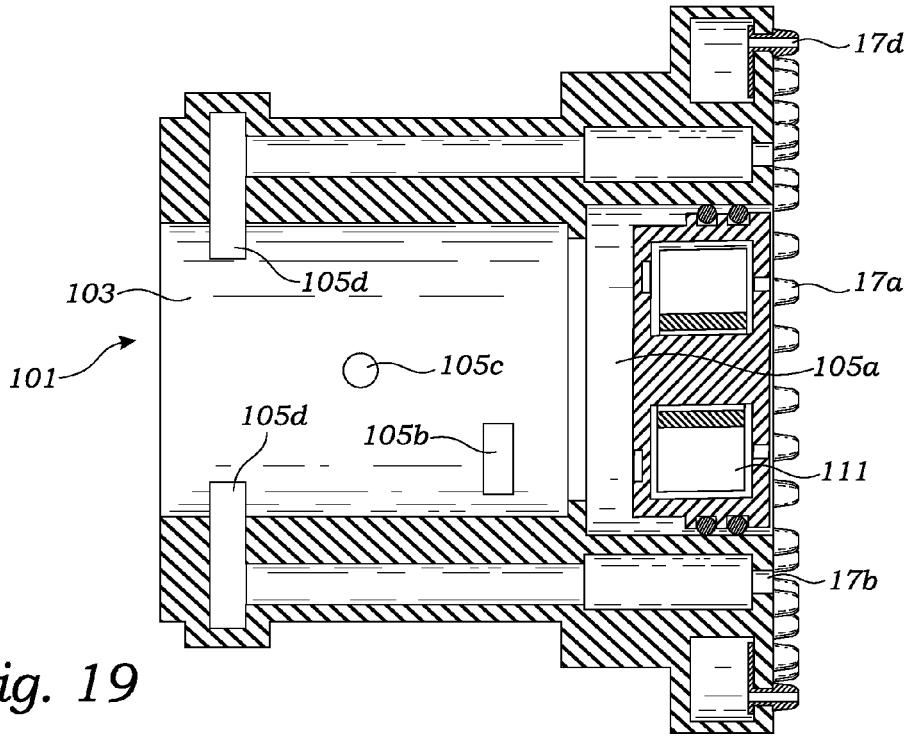
FIG. 19 is a left side cutaway view of the showerhead for use with the showerhead assembly of the present invention as illustrated in FIG. 10.
Figure 20:
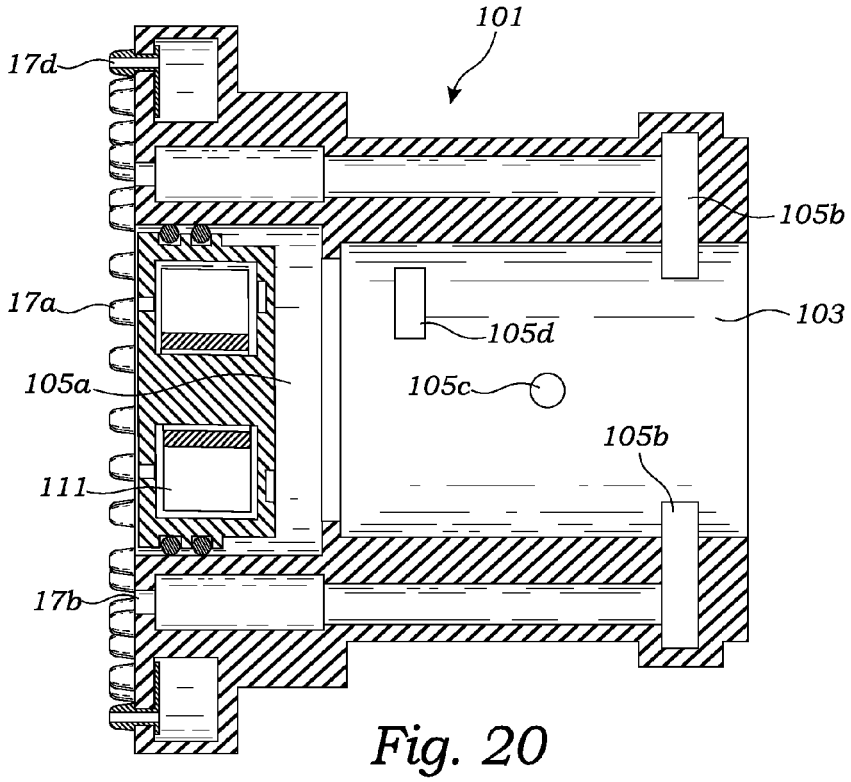
FIG. 20 is a right side cutaway view of the showerhead for use with the showerhead assembly of the present invention as illustrated in FIG. 10.
Figure 21:
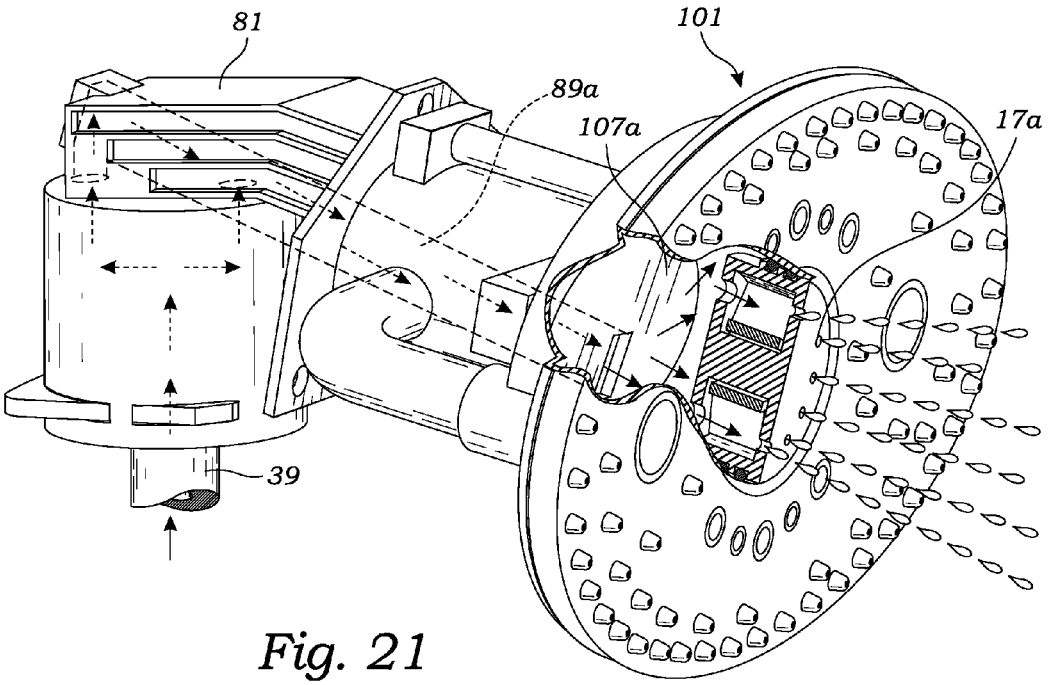
FIG. 21 is a perspective view of the diverter assembly and showerhead illustrating fluid flow producing a first spray pattern.
Figure 22:
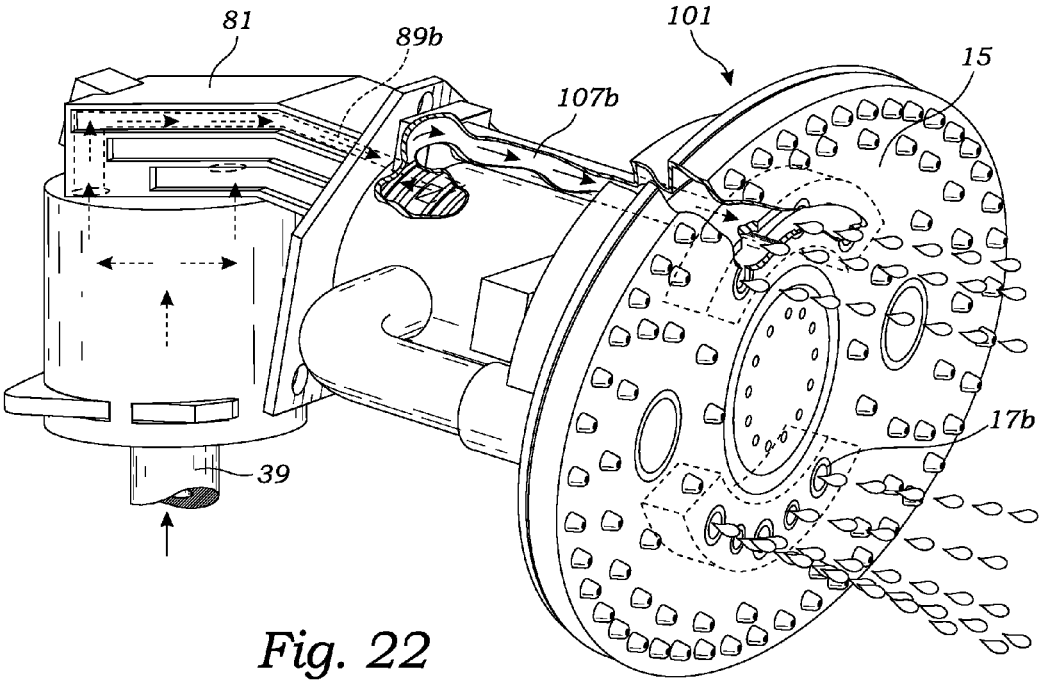
FIG. 22 is a perspective view of the diverter assembly and showerhead illustrating fluid flow producing a second spray pattern.
Figure 23:
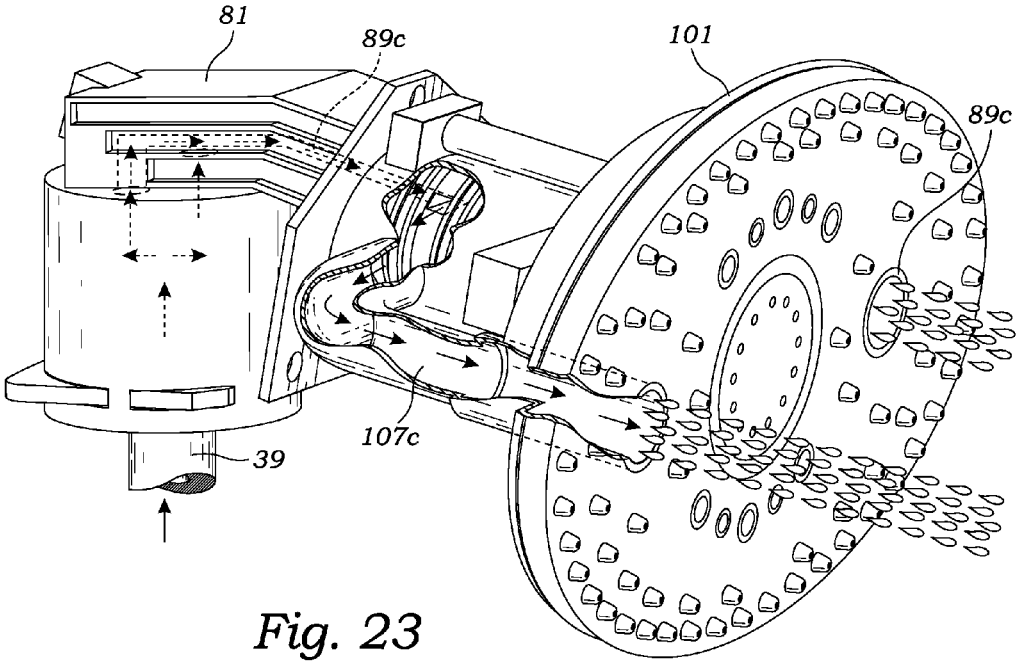
FIG. 23 is a perspective view of the diverter assembly and showerhead illustrating fluid flow producing a third spray pattern.
Figure 24:
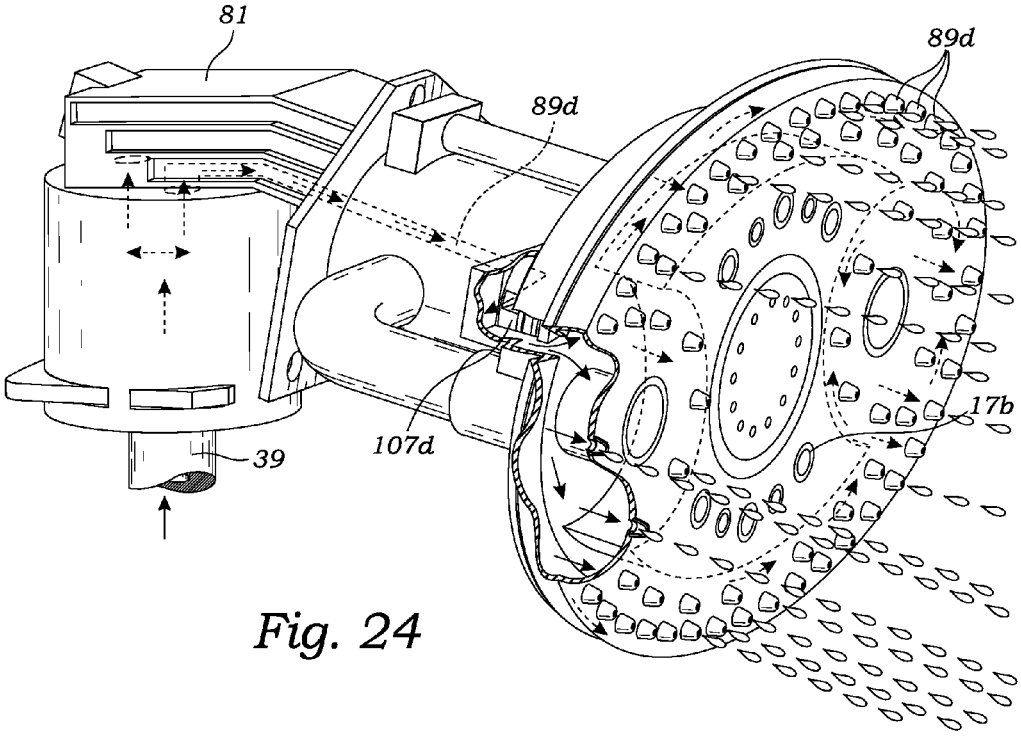
FIG. 24 is a perspective view of the diverter assembly and showerhead illustrating fluid flow producing a fourth spray pattern.
Figure 25:
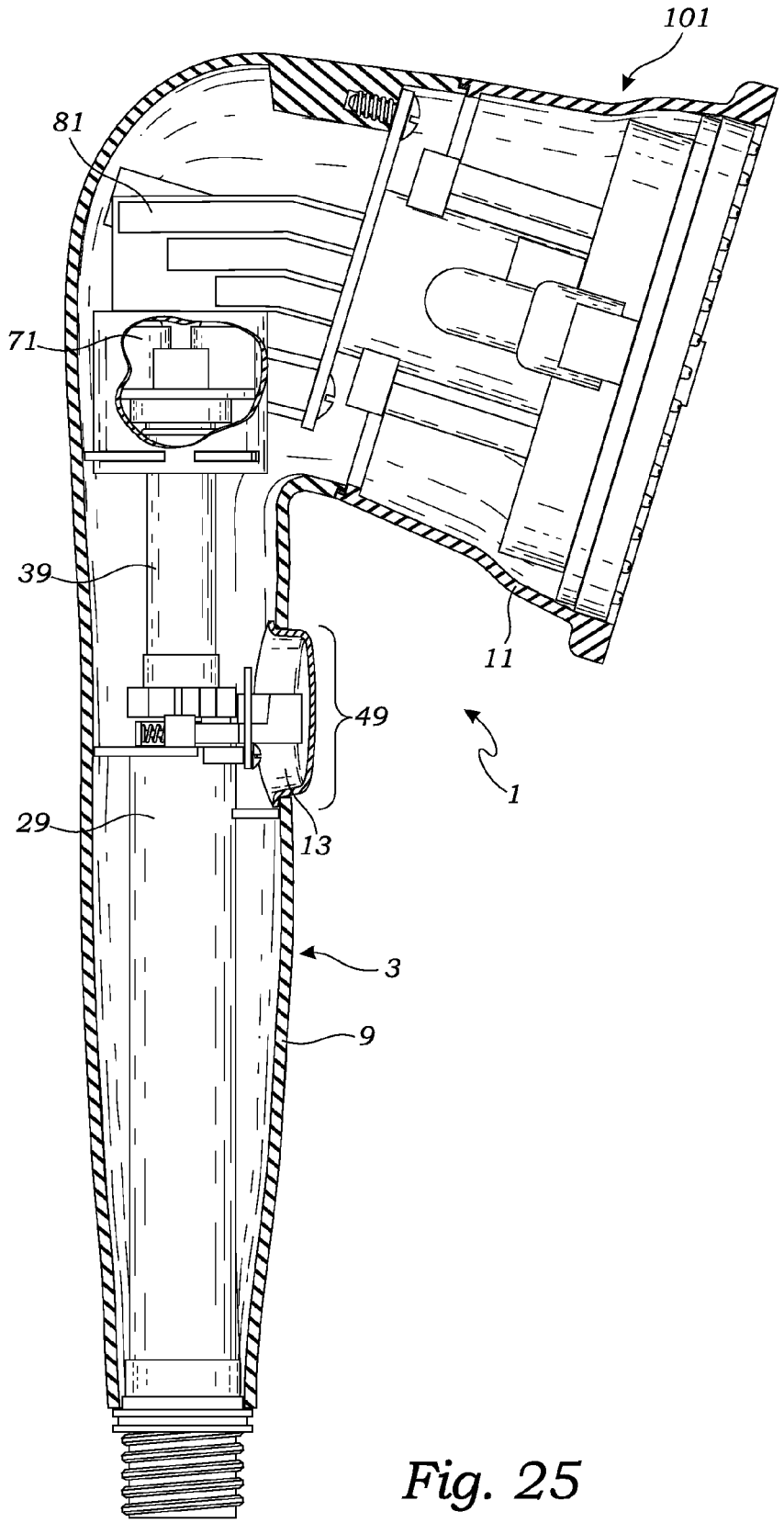
FIG. 25 is a side cutaway view of the showerhead assembly of the present invention.

The diverter inlet ports 87*a*-87*d* are connected to diverter assembly outlet ports 93*a*-93*d* located in the diverter assembly's discharge portion 91. Furthermore, the diverter assembly includes discrete pathways 89*a*-89*d* for connecting respective diverter inlet ports to corresponding diverter outlet ports. For example, with reference to FIGS. 9A, 9B, 11 and 12, the diverter assembly includes a first pathway 89*a* which connects the pair of diverter inlet ports 87*a* to a single diverter outlet port 93*a* so that water can be communicated directly from inlet ports 87*a* to the diverter outlet port 93*a*. With reference also to FIGS. 13 and 14, preferably the diverter assembly includes a second diverter pathway 89*b* for connecting the pair of inlet ports 87*b* to a pair of outlet ports 93*b*. With reference to FIGS. 15 and 16, a preferred diverter assembly includes a third pathway 89*c* for connecting the pair of inlet ports 87*c* to the pair of outlet ports 93*c*. And finally, with reference to FIGS. 17 and 18, the preferred showerhead assembly 1 includes a diverter assembly including a fourth pathway 89*d* which connects the pair of inlet ports 87*d* to the pair of outlet ports 93*d*.

The diverter assembly's discharge portion is constructed to rotatably connect to a showerhead 5. The rotatable connection between the diverter assembly 81 and showerhead 5, allowing for the supply of water from discrete pathways, can be determined by those skilled in the art. Thus the Applicant's preferred construction is not considered the only construction within the scope of the invention. However, in the preferred embodiment illustrated in the figures, the diverter assembly's discharge portion 91 is barrel shaped and includes a plurality of collars 95 which fluidly separate water supplied from the respective outlet ports 93*a*-93*d*. Preferably, O-rings 63 are provided to provide a fluid tight seal With reference to FIGS. 10, 19 and 20, the showerhead 5 includes a central cavity 103 for receiving and coupling to the diverter assembly's discharge portion 91 to provide a fluid tight construction. The showerhead 5 includes a plurality of inlet openings for receiving water to be sprayed from a plurality of sets of showerhead spray holes. Though the showerhead 5 may include any number of sets of spray holes providing any number of spray patterns, the preferred construction provides for four sets of inlet openings 105*a*-105*d* connected to four sets of spray holes 17*a*-17*d* by four sets of showerhead passageways 107*a*-107*d* to provide four distinct spray patterns. As illustrated in FIGS. 3 and 21-26, the preferred showerhead patterns include a first center pulsating massage spray provided by spray holes 17*a*, a second flood spray pattern provided by spray holes 17*b*, a twin jet spray pattern provided by spray holes 17*c*, and an oval spray pattern provided by peripheral spray holes 17*d*. Though not shown, one or more of the showerhead passageways may incorporate venturi inlets for introduction of air into the passageway to produce an air-water mixture which is expelled from the downstream spray holes.

As illustrated in FIGS. 19-26, a first diverter assembly outlet 93*a* is coupled to the showerhead's first inlet opening 105*a* for supplying water to spray holes 17*a*. The showerhead's inlet opening 105*a* includes a showerhead turbine 111 providing a pulsating supply of water to the respective showerhead holes 17*a*. Meanwhile, the diverter assembly's second outlet ports 93*b* are connected to a pair of showerhead inlet openings 105*b* for supplying water through showerhead passageway 107*b* to spray holes 17*b* producing a flood spray pattern. Similarly, the diverter assembly's third outlet ports 93*c* are connected to the showerhead inlet openings 105*c* to supply water through the showerhead passageway 107*c* to spray holes 17*c* to provide a twin jet spray pattern. Finally, the diverter assembly's fourth set of outlet ports 93*d* are coupled to the showerhead's inlet opening 105*d* to supply water to showerhead passageways 107*d* to spray holes 17*d* to provide the fourth oval spray pattern.

Figure 26:
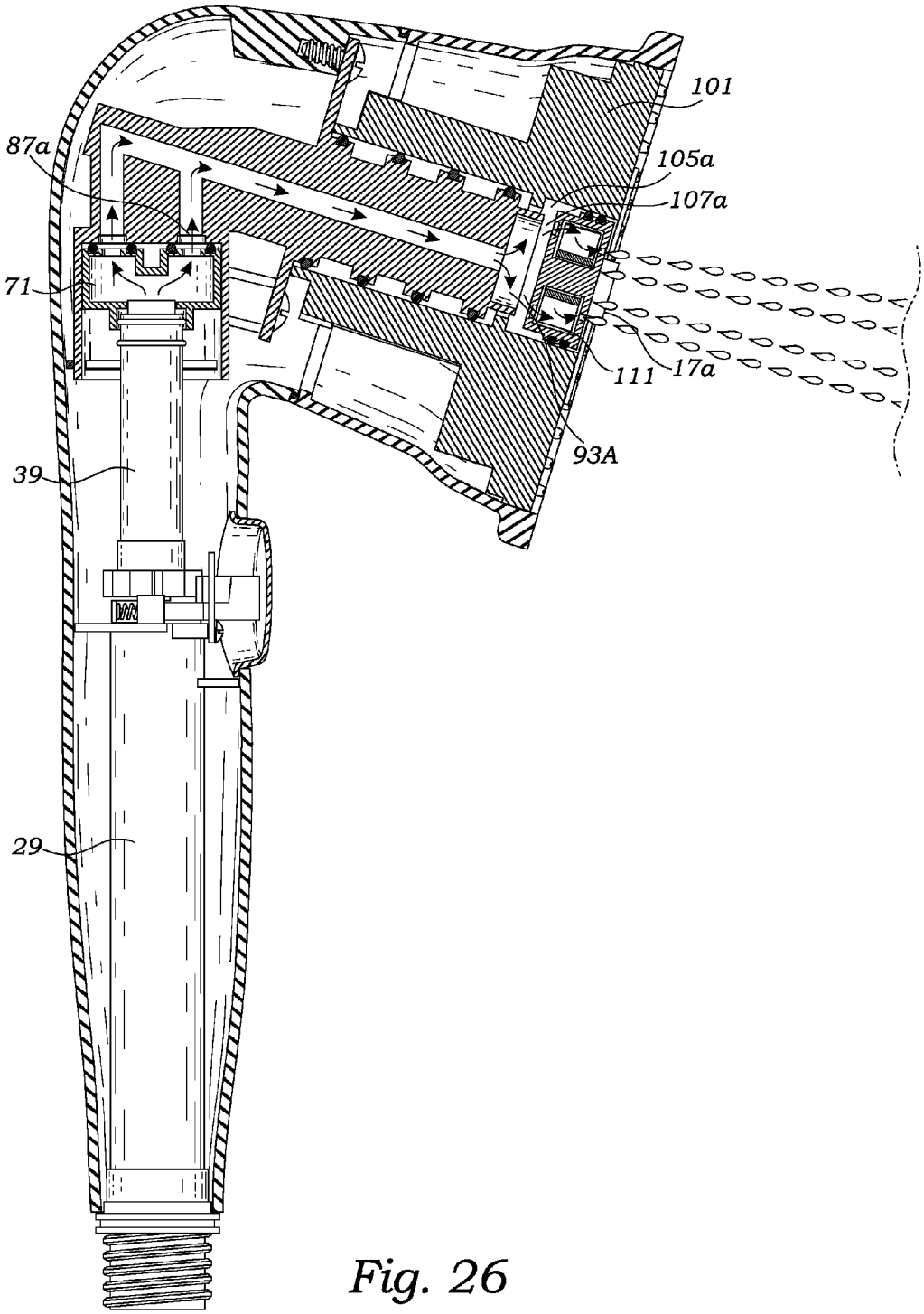
FIG. 26 is a side cutaway view of the showerhead assembly of the present invention illustrating water flow producing a first spray pattern.
Figure 27:
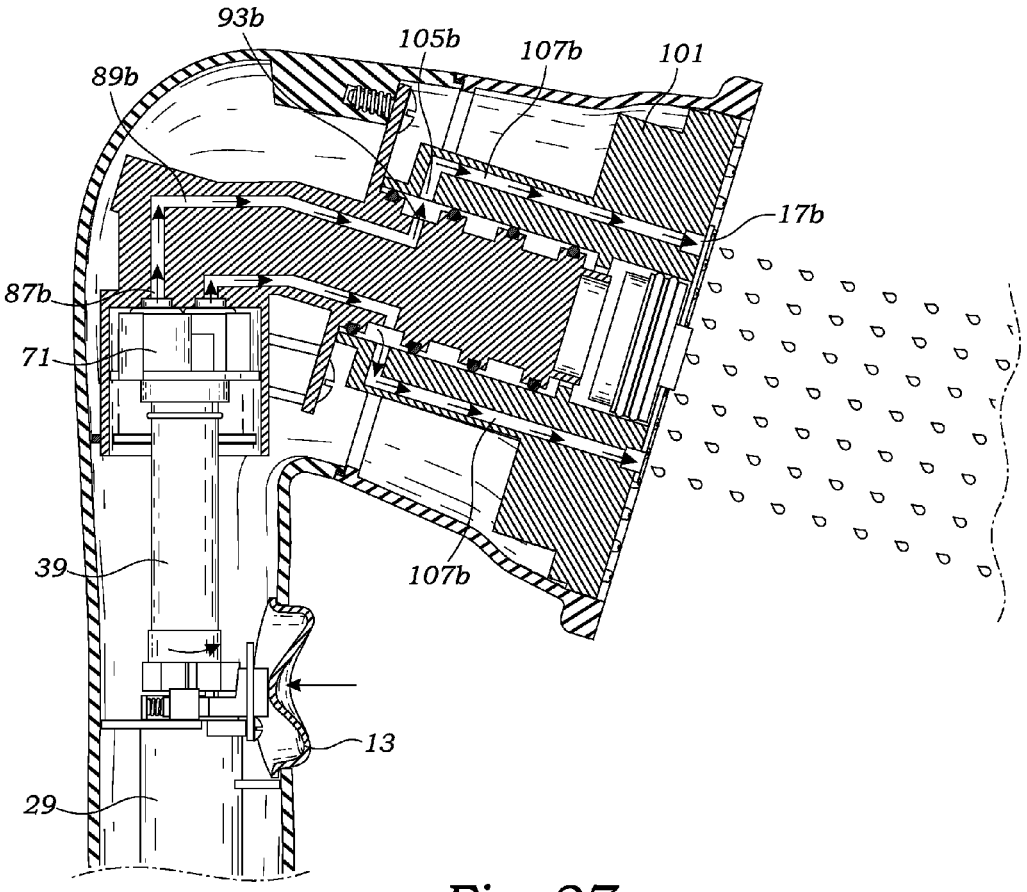
FIG. 27 is a cutaway side view of the showerhead assembly of the present invention illustrating water flow producing a second spray pattern.
Figure 28:
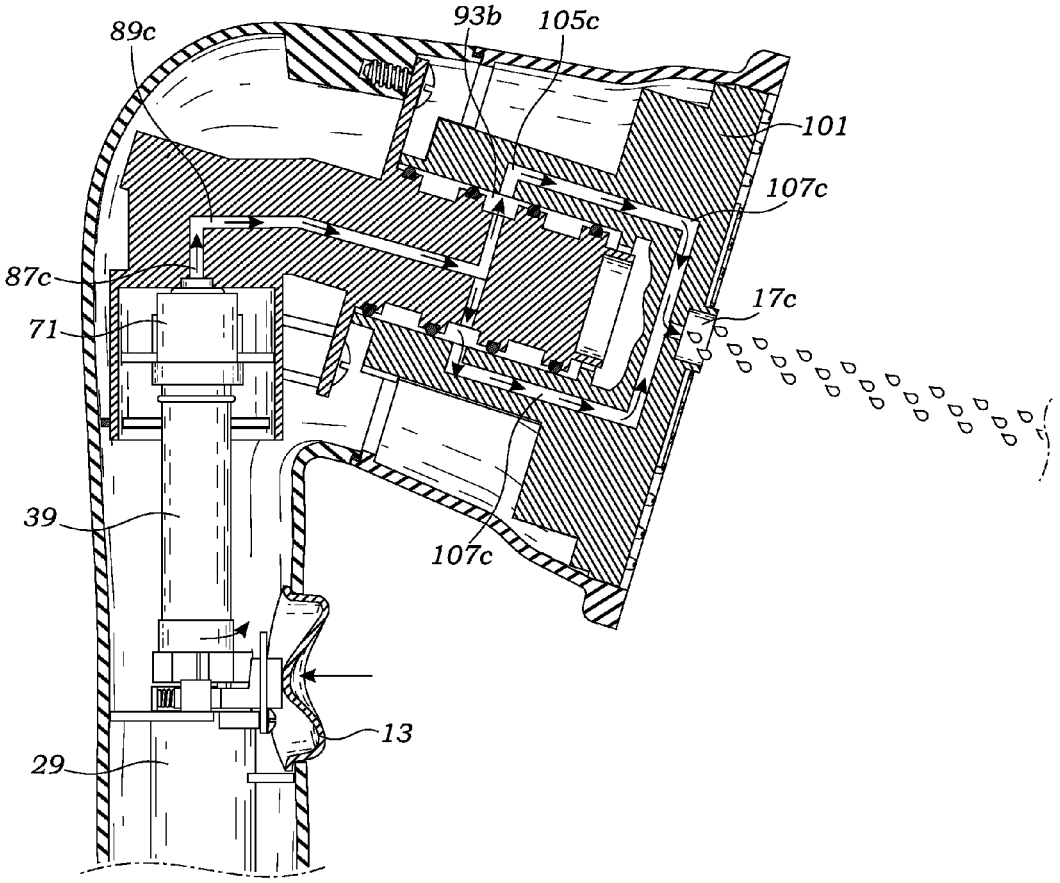
FIG. 28 is a cutaway side view of the showerhead assembly of the present invention illustrating water flow producing a third spray pattern.
Figure 29:
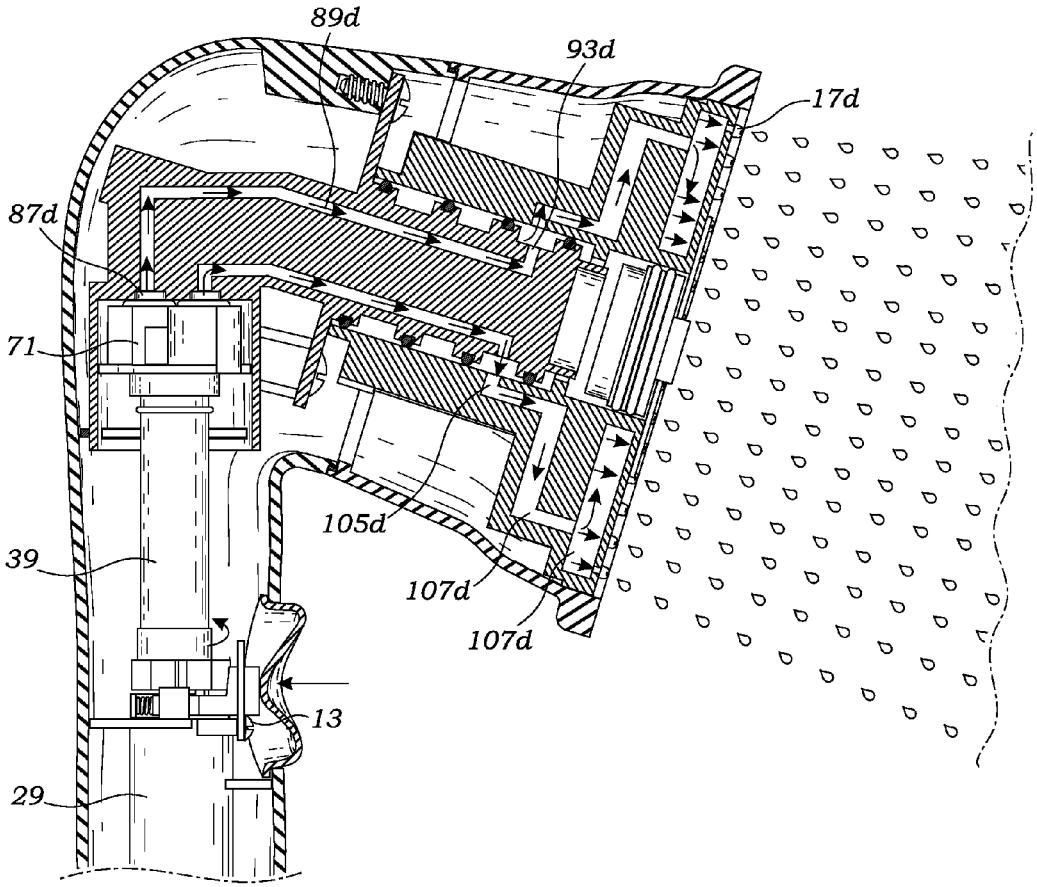
FIG. 29 is a cutaway side view of the showerhead assembly of the present invention illustrating water flow producing a fourth spray pattern.
Figure 30:
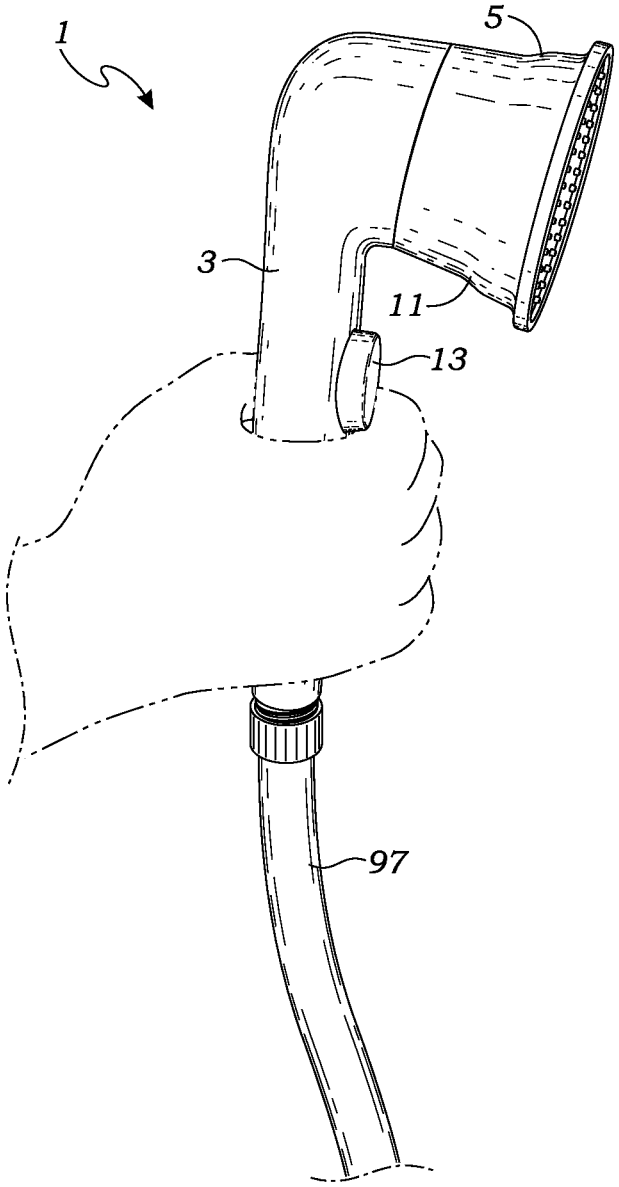
FIG. 30 is a perspective view of the showerhead assembly of the present invention including a flexible hose for connecting to a water source.

As best seen in FIGS. 6 and 21-26, the rotation of the rotatable pipe 39 causes the selection of a preferred spray pattern by causing supplied water to flow through a selected set of pathways 89*a*-89*d* to corresponding showerhead passageways 107*a*-107*d* to corresponding spray holes 17*a*-17*d*. Each set of diverter inlet ports 87*a*-87*d* includes a pair of inlet ports which are concentrically opposite to one another (see FIG. 9B) so as to connect to the coupling's outlet ports 75. For example, FIG. 26 illustrates the coupling 71 rotated so that its corresponding outlet ports 75 connect to diverter assembly inlet ports 87*a* so as to communicate water through diverter pathway 89*a*, through showerhead passageway 107*a* to the first set of spray holes 17*a*. With reference to FIG. 27, rotation of the coupling 45° ($1/8^{th}$ of a circle) causes the coupling's outlet ports to couple to the diverter's second set of inlet ports 87*b* so as to divert water through diverter pathway 89*b*, through showerhead passageway 107*b* to the second set of spray holes 17*b*. Similarly, an additional rotation of the coupling 45° will cause the coupling outlet port 75 to connect to diverter inlet ports 87*c* so as to divert water through the third diverter pathway 89*c* and third showerhead passageway 107*c* to the showerhead spray holes 17*c*. Still an additional rotation of the coupling 45° will cause the coupling outlet ports to connect to the diverter assembly's fourth set of inlet ports 87*d* so as to divert water through the fourth diverter pathway 89*d* and through showerhead passageway 107*d* so as to expel water from the showerhead's fourth set of spray holes 17*d*. Any additional rotation of the coupling will cause this process to repeat as the coupling will be aligned 180° from its initial starting point after four rotations of 45° so that the coupling's oppositely positioned outlet ports 75 will be aligned as in their starting position.

The rotation of the rotatable pipe 39 can be controlled utilizing various constructions. For example, the rotatable pipe could be rotated by simply including a concentric dial around the rotatable pipe which projects through a slot formed in the handle's housing 9 (not shown). However, the preferred controller for rotating the rotatable pipe 39 is illustrated in FIGS. 6-8 and 26-29. The rotatable pipe is rotated utilizing a ratchet assembly 49. The ratchet assembly includes eight teeth 51 positioned concentrically 45° around the rotatable pipe. The rotatable pipe further includes a button 53 which projects through a hole 10 formed in the handle's housing 9. Preferably, the ratchet assembly includes a flexible button cover 13 for providing a fluid tight seal for preventing water from entering the handle's housing 9. The button includes a tab 55 for engaging the teeth 51. Furthermore, the ratchet assembly 49 includes springs or the like 57.

In operation, depression of the button cover 13 and underlying button 53 causes the tab to engage the teeth 51 so as to rotate the rotatable pipe 45° with each depression of the button. As explained in greater detail above, the rotation of the rotatable pipe causes the coupling 71 and corresponding outlet ports 75 to rotate so as to properly align with the diverter assembly inlet ports 87*a*-87*d* to provide a desired spray pattern.

Figure 2:
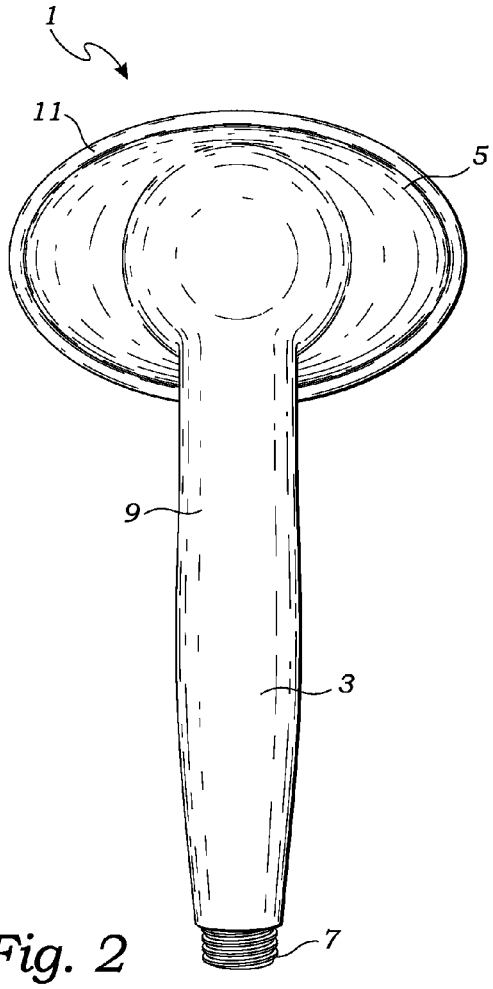
FIG. 2 is a rear view of the showerhead assembly of the present invention.
Figure 3:
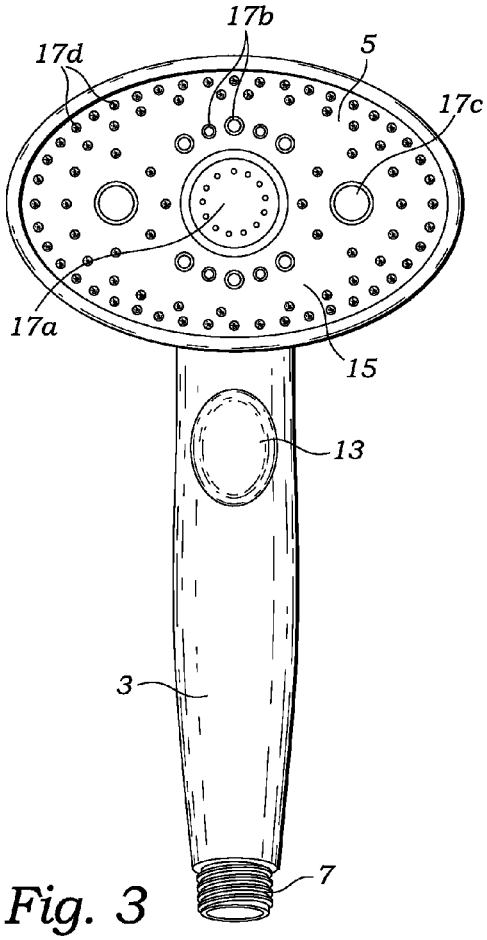
FIG. 3 is a front view of the showerhead assembly of the present invention.
Figure 4:
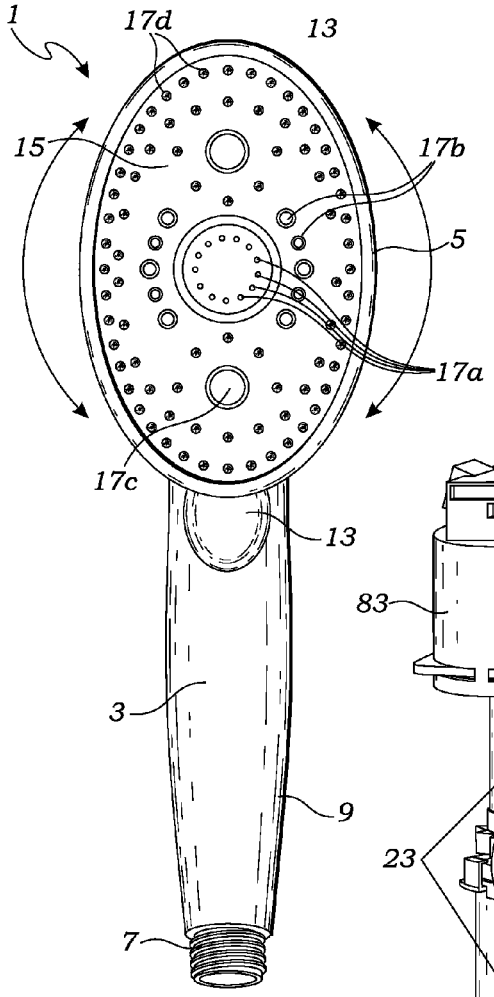
FIG. 4 is a front view of the showerhead assembly shown in FIG. 3 with the showerhead rotated 90°.
Figure 5:
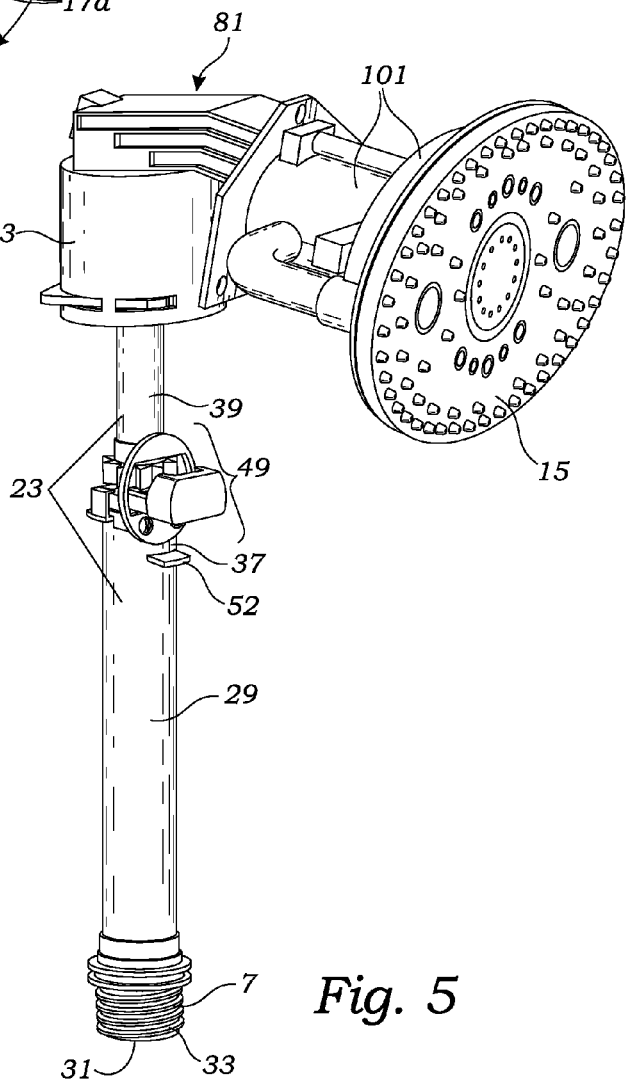
FIG. 5 is a perspective view of the showerhead assembly of the present invention with the housing removed.

Advantageously, the handheld showerhead assembly 1 of the present invention includes a controller located within the showerhead assembly's handle so as to allow one handed control of the handheld shower assembly including the selection of desired spray patterns. In addition, the rotational attachment of the showerhead 5 to the handle 3 permits rotation of the showerhead and its corresponding face 15 and spray holes 17*a*-17*d* without altering the spray patterns, other than the spray patterns' orientation. Thus, as illustrated in FIGS. 2-4, the showerhead 5 can be rotated from a horizontal position (see FIG. 3) to a vertical position (see FIG. 4).

Correspondingly, an oval spray pattern produced through holes 17*a* can be rotated from providing a horizontal orientation to a vertical orientation or any angle there between.

The present invention provides an improved handheld showerhead assembly. While a preferred showerhead assembly has been illustrated and described, it will be apparent that various modifications can be made without departing from the spirit and scope of the invention. Accordingly, it is not intended that the invention be limited except by the following claims.

I claim:

1. A showerhead apparatus comprising:

a flexible hose having first and second ends, said hose first end connectable to a water supply; and a handle assembly having a handle housing including an elongate hollow handle defining a central axis, an angled bend, and a handle outlet defining a spray axis at an angle greater than 45° and less than 135° relative to said handle's central axis, said showerhead handle assembly further including a handle conduit having an inlet connected to said hose second end and an outlet, said handle conduit extending within and through said elongate hollow handle, said angled bend, and said handle outlet;

a showerhead assembly rotatably connected to said handle assembly wherein said showerhead assembly includes a showerhead housing which rotatably connects to said handle outlet, said shower head assembly having at least one passageway extending through said showerhead housing for the passage of water, an inlet rotatably connected to said handle conduit's outlet for receipt of water into said showerhead's passageway, and a plurality of spray holes connected to said showerhead's passageway for expelling water from said showerhead assembly to produce a spray pattern which sprays in the direction of said spray axis, said spray holes arranged to produce an oval spray pattern having a long axis, said showerhead assembly rotatably connected to said handle assembly so that the said showerhead expels said oval spray pattern into the direction of said spray axis which is at an angle greater than 45° and less than 135° relative to said handle's central axis;

said showerhead assembly being manually rotatable about said spray pattern axis where said showerhead assembly rotatably connects to said handle assembly so as to permit the manual rotation of said oval spray pattern to provide said oval spray pattern as vertically aligned, horizontally aligned, or aligned therebetween, but said showerhead assembly connected to said handle assembly wherein rotation of said shower head relative to said handle does not disengage said showerhead from said hollow handle, said showerhead assembly is also connected to said handle assembly so as to prevent pivotal movement of said showerhead assembly and said spray axis relative to said handle assembly.

2. A showerhead apparatus of claim 1 wherein said handle's angled bend forms an elbow construction so that said showerhead assembly expels water at an angle greater than 90° and less than 120° relative to said handle's central axis.

3. A showerhead apparatus of claim 1 wherein said showerhead assembly produces a plurality of selectable spray patterns including said oval spray pattern, the manual rotation of said showerhead assembly relative to said handle assembly causing the manual rotation of a selected spray pattern relative to said handle's central axis.

4. A showerhead apparatus of claim 3 wherein said manual rotation of said showerhead assembly relative to said handle assembly does not cause said spray pattern to switch to an alternative spray pattern.

5. A showerhead apparatus of claim 4 wherein said showerhead apparatus includes a controller separate from said manual rotation of said showerhead relative to said handle to select one of said selectable spray patterns.

6. A showerhead apparatus of claim 5 wherein said controller is a push button controller located in said handle assembly.

* * * * *